United States Patent [19]

Hinds

[11] 4,226,069

[45] Oct. 7, 1980

[54] SHINGLE SIMULATING STRIP MATERIAL

[75] Inventor: Caryl E. Hinds, Norwood, Mass.

[73] Assignee: Bird & Son, Inc., East Walpole, Mass.

[21] Appl. No.: 14,368

[22] Filed: Feb. 23, 1979

Related U.S. Application Data

[63] Continuation-in-part of Ser. No. 875,240, Feb. 6, 1978, abandoned.

[51] Int. Cl.[2] ..... E04D 1/00

[52] U.S. Cl. ..... 52/521; 52/528; 52/631

[58] Field of Search ..... 52/521, 528, 631, 315, 52/545

[56] References Cited

U.S. PATENT DOCUMENTS

| | | | |
|---|---|---|---|
| 1,394,149 | 10/1921 | Cumfer et al. | 52/315 X |
| 1,518,988 | 12/1924 | Lehon | 52/315 X |
| 2,184,328 | 12/1939 | Wildman | 52/545 X |
| 2,305,008 | 12/1942 | Howard | 52/521 |
| 2,402,731 | 6/1946 | Clements | 52/545 |
| 3,422,589 | 1/1969 | Harrison | 52/528 X |

FOREIGN PATENT DOCUMENTS

| | | | |
|---|---|---|---|
| 988673 | 5/1976 | Canada | 52/528 |

*Primary Examiner*—Price C. Faw, Jr.
*Assistant Examiner*—Carl D. Friedman

[57] ABSTRACT

Shingle simulating laminated flat strip sheet material for application in horizontally extending weatherproof interlocked courses, comprising a thin, flexible underlying plastic base sheet having a self sealing asphalt mastic coating layer and a mineral granule front surface layer. The strip material has on each of its opposite faces a longitudinally extending groove adjacent to and spaced from opposite ones of its longitudinally extending edges, so that the strip material is foldable along the grooves around the edge of an adjacent folded strip edge.

1 Claim, 4 Drawing Figures

FIG 1
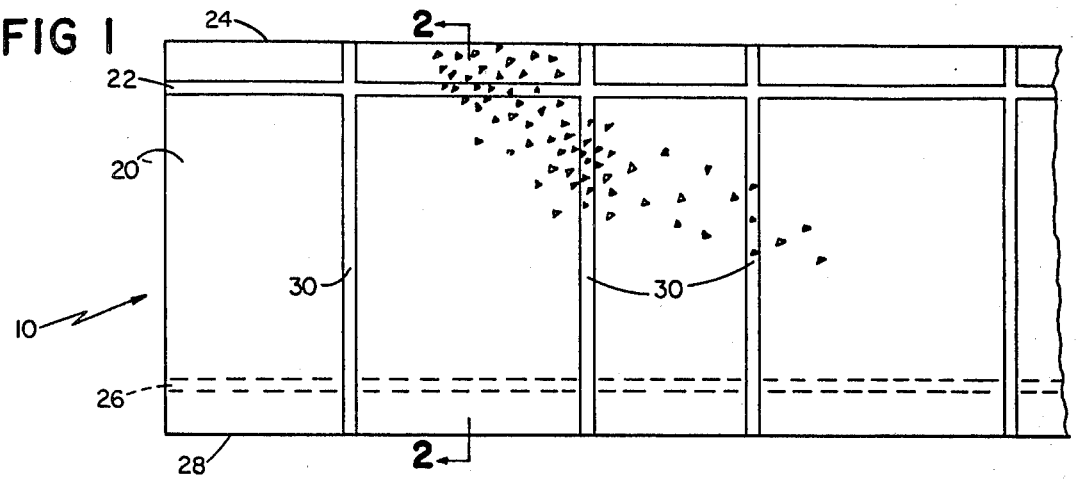
FIG 2
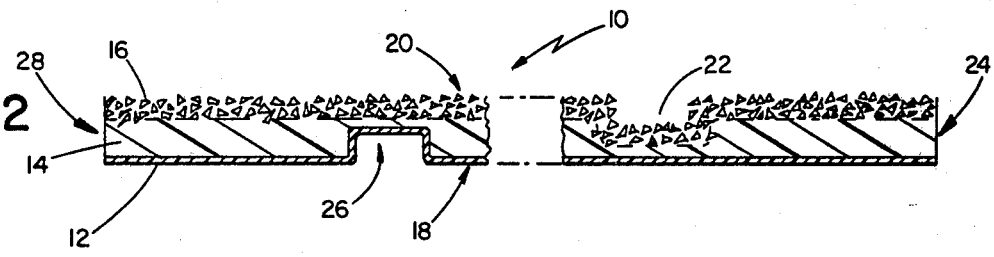
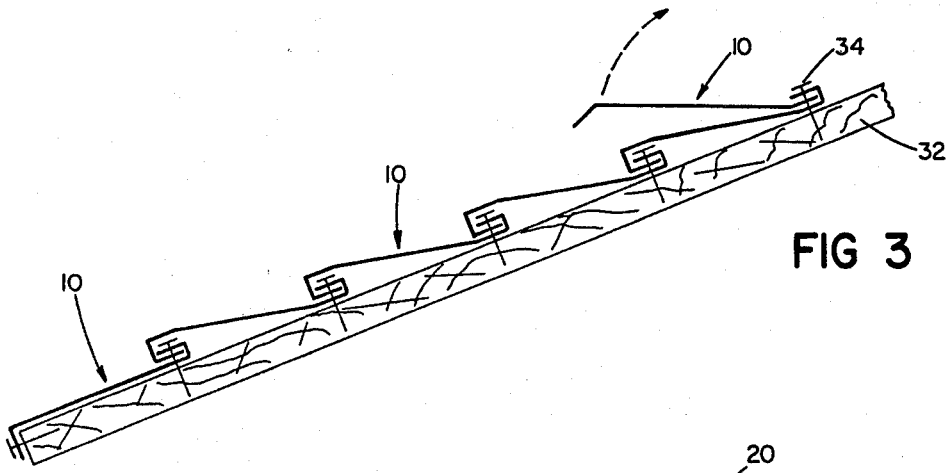
FIG 3
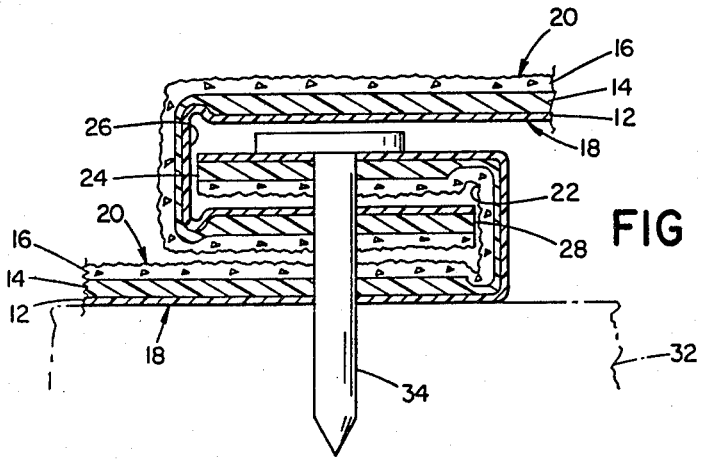
FIG 4

SHINGLE SIMULATING STRIP MATERIAL

This application is a continuation-in-part of my earlier application, Ser. No. 875,240, now abandoned, filed Feb. 6, 1978.

Its invention relates to roofing, siding and the like and, more particularly, to flexible, shingle simulating strip material for application in horizontally extending interlocked courses.

There has long been a need in the art for an attractive, shingle simulating strip material, which may be manufactured at relatively low cost, which can be rolled up for shipment, and which can be quickly and easily applied by inexperienced labor or concealed stapling or nailing to an underlying substrate to provide a weatherproof covering. Although attempts have been made over the years to provide such a material, they have all proved to be deficient in one respect or another.

Accordingly, it is an object of the present invention to provide a flat strip material which can nevertheless be applied with interlocking of the edges of adjacently applied strips.

It is another object of the invention to provide an attractive, shingle simulating material for application in horizontally extending courses.

It is still another object of the invention to provide a flat strip material which can be applied by nailing and which will self seal around the nail shanks and conceal the nail heads within the interlocked edges of horizontally extending courses.

It is a still further object of the invention to provide a flexible flat strip material which is made of the extact width of the roof to be covered and so avoid end joints and which also can be rolled up for shipment.

It is yet another object of the invention to provide a flat strip material which can be quickly and easily applied by inexperienced labor by nailing it to a substrate to provide a weatherproof covering of horizontally extending courses with interlocked edges and concealed nails, as well as one which is impervious to ice dam and wind damage problems.

In order to accomplish the above objects, the present invention provides a novel flexible, laminated flat strip sheet material adapted to be laid in horizontally extending, weatherproof, interlocked courses on a roof deck and secured thereto by concealed fastening means. It comprises a thin, flexible, underlying plastic base sheet of between about 1 to 10 mils thickness, a self sealing asphalt mastic coating layer, preferably having a thickness of about 0.050–0.100 inches, adhered to the front face only of the base sheet, the rear face of the base sheet forming the rear face of the laminated strip material, and a mineral granule front surface layer, preferably having à thickness of about 0.030–0.050 inches, adhered directly to the asphalt mastric coating layer, the mineral granule layer forming the front face of the laminated sheet material. The laminated strip material has on its front face a single longitudinally extending groove adjacent to and spaced from one of its longitudinally extending edges and on its rear face a single longitudinally extending groove adjacent to and equally spaced from the other of its longitudinally extending edges. The grooves preferably extend for a depth of about one-half of and have a width at least about equal to and preferably about twice the thickness of the laminated sheet material. The laminated strip material is foldable along the grooves for 180 degrees around the edge of a second, adjacent strip of laminated strip material without damaging the laminated strip material for double 180 degree fold interlocking of the edges of adjacently applied strips of the strip material to conceal the fastening means. The fastening means extends through the first strip material into the roof deck for securing the strip to the deck, the asphalt sealing material automatically seaing around the shanks of the fastening means and preventing the passage of moisture through the holes formed in the first laminated strip material by the fasteing means. The front face of the laminated material may have a plurality of transversely extending shingle simulating appearance stripes.

For the purpose of more fully explaining the above and still further objects and features of the invention, reference is now made to the following detailed description of a preferred embodiment thereof, together with the accompanying drawings, wherein:

FIG. 1 is a plan view of the front face of the strip material of the invention;

FIG. 2 is a diagrammatic side cross-sectional view of the strip material of FIG. 1, taken on line 2—2 thereof;

FIG. 3 is a diagrammatic side cross-sectional view of the strip material of FIG. 1, applied in several horizontally extending interlocked courses; and FIG. 4 is an enlarged detail view of the interlocked and nailed edges of adjacent strips.

Referring to the drawings, the novel laminated flat strip of the invention, generally designated 10, has a thin, flexible underlying plastic base sheet 12, a self sealing asphalt mastic coating layer 14 adhered to the front face only of base sheet 12 and a mineral granule front surface layer 16 adhered directly to the asphalt mastic coating layer 14. The rear face of base sheet 12 forms the rear face 18 of strip 10 and the front surface of mineral layer 16 forms the front face 20 of strip 10. On its front face 20, strip 10 has a single longitudinally extending groove 22 adjacent to and spaced from its longitudinally extending edge 24 and on its rear face 18, strip 10 has a single longitudinally extending groove 26 adjacent to and equally spaced from its other longitudinally extending edge 28. As hereinafter more fully explained, grooves 22 and 26 function as guide and hinge lines during application of strips 10 in horizontally interlocked courses.

To enhance its shingle simulating appearance, strip 10 may have, on its front face 20, a plurality of transversely extending shingle simulating appearance stripes 30, which preferably have random spacing.

In order to provide a highly flexible strip 10 which can be rolled up for shipment and folded at its edges for 180 degree fold interlocking of the edges of adjacently applied strips 10, it is important that base sheet 12 be highly flexible, even at temperatures as low as 20 degrees F. To accomplish this, base sheets of no more than between about 1 to 10 mils in thickness must be used, preferably in the form of a mat of 5 to 10 mils thickness of bonded non-woven plastic fibers, such as, for example, DuPont "Typar", a non-woven polypropylene sheet material. Other types of non-woven fibrous mat may include polyethylene and polyester fibers. Plastic films and foams, of 1 to 10 mils thickness, may also be used, such as polyester, polyvinyl chloride, polyvinyl fluoride, polyethylene, and polypropylene.

The self sealing asphalt mastic coating layer 14 is applied to base sheet 12 in a thickness of about 0.050 to 0.100 inches by conventional coating techniques. Its preferred composition, by way of example, is as follows:

| | Range | *Preferred |
|---|---|---|
| Grade A Asphalt | 35-45% | 40% |
| Ground Limestone Filler | 55-65% | 60% |

*Softening point 200° F., application temperature 350° F.

The specifications of the Grade A asphalt are as follows:

| | |
|---|---|
| S.P., °F. | 170 |
| Penetration 77° F. | 40 |
| Flash Point, °F. | 500 |

An alternative mastic asphalt composition is as follows:

| | Range | *Preferred |
|---|---|---|
| #21 Asphalt | 40-55% | 46% |
| #18 Asphalt | 35-50% | 46% |
| Vistac "P" | 5-10% | 8% |

*Softening point 200° F., application temperature 350° F.

The specifications of these components are as follows:

| | | Min. | Std. | Max. |
|---|---|---|---|---|
| 1. | #21 Asphalt | | | |
| | S.P., °F. | 128 | 130 | 132 |
| | Penetration 77° F. | 55 | 60 | 65 |
| | Flash Point, °F. | 550 | — | — |
| | Sp. Gr. 60° F. | | 1.0383 | |
| 2. | #18 Asphalt | | | |
| | S.P., °F. | 224 | 226 | 228 |
| | Penetration 77° F. | 15 | 16 | 17 |
| | Ductility 77° F. | 2.5 | — | — |
| | Flash Point, °F. | 550 | — | — |
| | Sp. Gr. 60° F. | | 1.0277 | |
| 3. | Interstab Vistac "P" Modifier (Preferred) | | | |
| | Sp. Gr. | 0.895 | | |
| | Flash Point, COC, °F. | 375 | | |
| | Viscosity, CP | 3475 ± 30, Brookfield 120° C. | | |

An alternative Modifier for the Interstab Vistac "P" is:

| Exxon Butyl Rubber 268; Specifications - | | |
|---|---|---|
| Sp. Gr. | | 0.92 |
| Mooney Viscosity | 125° C. | 46 to 56 |
| Molecular Wt. | | 450 |

The asphalt mastic sealing material is characterized by its self sealing properties, in that it will automatically seal around the shanks of staples or nails driven through it and so prevent the passage of moisture through such holes in strip 10.

The mineral granule front surface layer 16 is embedded by pressure into the hot mastic asphalt coating layer 14 using conventional techniques and so is adhered directly to it. The granule surfacing adds 0.030"-0.050" to the asphalt coating film thickness. It consists of artifically colored rock granules of the following sizes:

| | | Min. | Std. | Max. |
|---|---|---|---|---|
| Preferred #11 Grading. | | | | |
| *Retained on | 8 mesh (.0937" opening) | 0% | 0% | 0% |
| | 10 mesh (.0787" opening) | 0 | 1 | 2 |
| | 14 mesh (.0555" opening) | 30 | 35 | 40 |
| | 20 mesh (.0331" opening) | 30 | 37 | 44 |
| | 28 mesh (.0232" opening) | 15 | 20 | 25 |
| | 35 mesh (.0197" opening) | 3 | 6 | 9 |
| Pass | 35 mesh (.0197" opening) | 0 | 1 | 2 |
| An alternate #9 Grading is as follows: | | | | |
| *Retained on | 4 mesh (.187" opening) | 0% | 0% | 0% |
| | 6 mesh (.132" opening) | 0 | 0.5 | 1 |
| | 8 mesh (.0937" opening) | 19 | 22 | 25 |
| | 10 mesh (.0787" opening) | 38 | 42 | 46 |
| | 14 mesh (.0555" opening) | 23 | 27 | 31 |
| | 20 mesh (.0331" opening) | 5 | 7 | 9 |
| | 28 mesh (.0232" opening) | 0 | 1 | 2 |
| Pass | 28 mesh (.0232" opening) | 0 | 0.5 | 1 |

*Granule gradings are Tyler screen scale equivalent to U.S. series designation.

An alternative material for granule surfacing is natural colored slate granules of suitable size as specified above.

The granular front face 20 is preferably cold embossed to provide the transverse appearance lines 30 better to simulate individual shingles.

The longitudinally extending grooves 22 and 26 are pressure indented by conventional techniques on the opposite faces of strip 10 adjacent to and equally spaced from opposite ones of its longitudinally extending edges 24, 28.

A typical strip 10 of the invention may be of total thickness range of about 0.10 to 0.15 inch and of about 8 inches in total width with grooves 22, 26 spaced about one inch from the edges 24, 28. Grooves 22 and 26 are preferably of a depth of about half of the thickness of strip 10 and are at least about equal to and preferably about double in width to the total thickness of strip 10, say about 0.25 inches wide. During application, the grooves 22, 26 function as guide and hinge lines to index the position of a freely manipulated 180° back fold along the edges at the time of application on the roof deck.

Referring now particularly to FIGS. 3 and 4, strips 10 are shown therein as applied to a wooden roof deck 32 by concealed nails 34.

The strip 10 of the first course is unrolled with the granule front face 20 up, and positioned flat along the lower edge of roof deck 32. The lower edge of this starter course is nailed or stapled to the leading edge of roof deck 32. The upper edge 24 of strip 10 is backfolded along groove 22 on its top face 20.

The strip 10 of the second course is unrolled base sheet face 18 up and laid directly on the first course strip 10. Upper edge 28 is inserted into the one inch wide slot formed by the backfold on upper edge 24 of the first course. The assembly is then nailed by nails 34 at about twelve inch intervals, to roof deck 32 through the three thicknesses of strips 10.

The second course of strip 10 is then folded upwards along groove 26 to conceal the heads of nails 34 and laid on roof deck 32 with the granular front surface 20 exposed. The second course of strip 10 is now ready to receive the third strip 10 which is handled in the same manner.

This application procedure is repeated for all subsequent courses up the roof deck, providing a series of horizontally extending courses with double 180 degree fold interlocking of their edges to conceal the heads of nails 34 and provide a superior weatherproof roof covering.

What is claimed is:

1. A first laminated strip material adapted to be laid in horizontally extending weatherproof interlocked courses on a roof deck and secured thereto by concealed fastening means, said first laminated strip material comprising an underlying plastic base sheet of between about 1 to 10 mils thickness and formed from a group consisting of plastic films, plastic foams and bonded nonwoven webs of plastic fibers a self sealing asphalt mastic coating layer having a thickness of about 0.050–0.100 inches adhered to the front face only of said base sheet, the rear face of said base sheet forming the rear face of said laminated strip material a mineral granule front surface layer having a thickness of about 0.030 to 0.050 inches adhered directly to said asphalt mastic coating layer, said mineral granule layer forming the front face of said laminated sheet material said laminated strip material having on its front face a single longitudinally extending groove adjacent to and spaced from one of its longitudinally extending edges and on its rear face a single longitudinally extending groove adjacent to and spaced from the other of its longitudinally extending edges said grooves extending for a width at least about equal to the total thickness of said strip material and for a depth of at least about one-half of the thickness of said strip material whereby said first laminated strip material is foldable along said grooves for 180 degrees around the edge of a second adjacent strip of said laminated strip material without damaging said laminated strip material, for 180 degree fold interlocking of the edges of adjacent strips of said strip material to conceal said fastening means, with said fastening means extending through said first strip material and into said roof deck for securing the strip to the deck, said asphalt mastic sealing material automatically sealing around the shanks of said fastening means and preventing the passage of moisture through holes formed in said first laminated strip material by the fastening means.

* * * * *